US007984603B2

(12) United States Patent
Freudenberg et al.

(10) Patent No.: US 7,984,603 B2
(45) Date of Patent: Jul. 26, 2011

(54) DEVICE FOR HANDLING BOBBINS OF PACKAGING MATERIAL

(75) Inventors: Harald Freudenberg, Marklohe (DE); Andreas Prahm, Barssel (DE); Frank Sachs, Saterland (DE); Michael Schlenker, Blender (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 227 days.

(21) Appl. No.: 12/295,971

(22) PCT Filed: Feb. 14, 2007

(86) PCT No.: PCT/EP2007/001261

§ 371 (c)(1),
(2), (4) Date: Oct. 3, 2008

(87) PCT Pub. No.: WO2007/118537

PCT Pub. Date: Oct. 25, 2007

(65) Prior Publication Data

US 2010/0154355 A1 Jun. 24, 2010

(30) Foreign Application Priority Data

Apr. 11, 2006 (DE) ..... 10 2006 017 379

(51) Int. Cl.
*B65B 41/12* (2006.01)
*B65H 19/12* (2006.01)

(52) U.S. Cl. ... 53/389.1; 53/389.2; 242/559; 242/559.1; 242/573.9

(58) Field of Classification Search ..... 53/389.1, 53/389.2, 389.4, 558; 242/532.5, 533, 533.2, 242/533.3, 559, 559.1, 559.4, 560, 561, 573, 573.9; 414/908, 910, 911
See application file for complete search history.

(56) References Cited

U.S. PATENT DOCUMENTS 3,695,539 A * 10/1972 Lindstaedt ..... 242/559
4,084,762 A * 4/1978 Repp ..... 242/597.3
4,366,932 A * 1/1983 Focke ..... 242/558
4,368,859 A * 1/1983 Focke et al. ..... 242/130
4,441,662 A * 4/1984 Seragnoli ..... 242/559.3
(Continued)

FOREIGN PATENT DOCUMENTS

DE 3202647 A1 9/1982
(Continued)

OTHER PUBLICATIONS

European Patent Office, International Search Report, Apr. 18, 2007.
(Continued)

*Primary Examiner* — Paul Durand
*Assistant Examiner* — Gloria R Weeks
(74) *Attorney, Agent, or Firm* — Laurence P. Colton; Smith Risley Tempel Santos LLC

(57) ABSTRACT

For supplying machines, namely packaging machines, with web-like packaging material which is present in the form of a reel, a reel store (15) is fitted out with a portal (16), in which the reels (10 . . . 13) are kept on pallets (14). A portal robot (20) with an articulated arm (27) transfers reels (10 . . . 13) as required to winding subassemblies (29 . . . 32) arranged outside the portal (16). From these winding subassemblies, the material webs are transported toward opposite sides, in the direction parallel to the longitudinal extent of the portal (16), to the consuming machines.

23 Claims, 9 Drawing Sheets

U.S. PATENT DOCUMENTS

| | | | | | |
|---|---|---|---|---|---|
| 4,615,494 | A | * | 10/1986 | Focke et al. | 242/597.3 |
| 4,708,300 | A | * | 11/1987 | Goetz | 242/551 |
| 4,840,321 | A | * | 6/1989 | Focke et al. | 242/422.3 |
| 4,854,520 | A | * | 8/1989 | Gavin et al. | 242/530.3 |
| 4,911,608 | A | * | 3/1990 | Krappitz et al. | 414/796 |
| 4,941,374 | A | * | 7/1990 | Focke | 83/13 |
| 5,031,381 | A | * | 7/1991 | Focke | 53/389.1 |
| 5,102,292 | A | * | 4/1992 | Brinker et al. | 414/796 |
| 5,205,505 | A | * | 4/1993 | Focke et al. | 242/559.3 |
| 5,209,247 | A | * | 5/1993 | Rittershaus et al. | 131/58 |
| 5,249,757 | A | * | 10/1993 | Draghetti et al. | 242/559.1 |
| 5,265,999 | A | * | 11/1993 | Wenschhof et al. | 414/226.02 |
| 5,269,479 | A | * | 12/1993 | Budin et al. | 242/559.4 |
| 5,487,638 | A | * | 1/1996 | Salsburg et al. | 414/796.9 |
| 5,601,252 | A | * | 2/1997 | Draghetti | 242/559.1 |
| 5,683,222 | A | * | 11/1997 | Ingelhag | 414/801 |
| 5,685,685 | A | * | 11/1997 | Beckmann | 414/225.01 |
| 6,076,763 | A | * | 6/2000 | Spatafora | 242/559.1 |
| 6,276,628 | B1 | * | 8/2001 | Focke et al. | 242/559.1 |
| 6,290,448 | B1 | * | 9/2001 | Focke et al. | 414/222.01 |
| 6,355,139 | B1 | * | 3/2002 | Baggot et al. | 162/109 |
| 6,604,704 | B2 | * | 8/2003 | Kiprowski | 242/559.1 |
| 6,718,727 | B2 | * | 4/2004 | Focke et al. | 53/168 |
| 6,767,318 | B2 | * | 7/2004 | Spatafora et al. | 493/303 |
| 7,201,553 | B2 | * | 4/2007 | Spatafora | 414/729 |
| 2003/0032538 | A1 | * | 2/2003 | Spatafora et al. | 493/81 |
| 2006/0155397 | A1 | * | 7/2006 | Focke et al. | 700/83 |

FOREIGN PATENT DOCUMENTS

| | | | |
|---|---|---|---|
| DE | 3425734 | A1 | 1/1985 |
| DE | 3631205 | A1 | 3/1988 |
| DE | 3718601 | A1 | 12/1988 |
| DE | 3835032 | A1 | 4/1990 |
| DE | 4018266 | A1 | 12/1991 |
| DE | 4221052 | A1 | 1/1994 |
| EP | 0994057EP | | 4/2000 |
| EP | 1157952 | A2 | 11/2001 |
| EP | 1256538 | A2 | 11/2002 |
| WO | WO02092483 | A1 | 11/2002 |

OTHER PUBLICATIONS

German Search Report, Jul. 28, 2006.

* cited by examiner

DEVICE FOR HANDLING BOBBINS OF PACKAGING MATERIAL

STATEMENT OF RELATED APPLICATIONS

This application is the U.S. National Phase Under Chapter II of the Patent Cooperation Treaty (PCT) of PCT International Application No. PCT/EP2007/001261 having an International Filing Date of 14 Feb. 2007, which claims priority on German Patent Application No. 10 2006 017 379.1 having a filing date of 11 Apr. 2006.

BACKGROUND OF THE INVENTION

1. Technical Field

The invention relates to a system for supplying production machines associated with the production of cigarette packs, in particular packaging machines, with consumable material, in particular with webs of paper, thin cardboard, film or tinfoil which are wound in the form of reels, it being the case that the reels are kept on pallets within a portal which has upright supports and a top, essentially horizontal carrying frame and forms part of a material store, and a respective reel can be fed by a robot, which is connected to the portal and has a lifting head, to a respective one of a plurality of winding subassemblies with operating spindles for receiving a respective reel. The invention also relates to an apparatus for transferring the reels from the robot to an operating spindle of a winding subassembly. In addition, the invention relates to a special lifting head for gripping and transporting reels.

2. Related Art

High-performance installations for the production of cigarette packs or similar complex packs comprising a plurality of blanks have an (interim) store in which is kept packaging material for a number of consuming machines, in particular packaging machines. The store is defined by an elongate, rectangular portal having upright supports and a top, horizontal carrying frame. The reels are positioned on pallets within the portal. A (portal) robot with a lifting head for gripping a respective reel can be displaced within the portal for the purpose of receiving a reel and transferring it to a winding subassembly. A plurality of winding subassemblies are arranged within the portal (DE 40 18 266). In the region of the winding subassemblies, the different webs of packaging material are drawn off from the reels and fed to the machines in a direction transverse to the longitudinal extent of the portal. The lifting head of the robot has a transporting spindle which, for the purpose of gripping a reel, is anchored in the central opening of the latter.

It is also known for a reel transported by an overhead conveyor to be transported to a pivotable operating spindle of a packaging machine in an upright position with the aid of a flanged wheel which can be displaced longitudinally on the operating spindle (DE 42 21 052). In the upright position of the operating spindle, the flanged wheel is moved into a top end position. The reel, which is retained on a transporting spindle of the overhead conveyor, is released onto the operating spindle in an axially aligned manner and passes onto the flanged wheel by way of downward movement. The flanged wheel is then moved downward into an operating position, the reel being carried along in the process. Thereafter, the operating spindle is moved into the horizontal position.

BRIEF SUMMARY OF THE INVENTION

The object of the invention is to improve the configuration of the portal and of the handling mechanisms for the reels so as to ensure a reliable and efficient supply to the winding subassemblies and/or to the consuming machines.

In order to achieve this object, the system according to the invention is characterized by the following features:

a) the in particular plurality of winding subassemblies are located outside the portal, directly adjacent to a longitudinal side of the same, b) the robot has an extension arm which can be pivoted in a horizontal plane and at the free end of which is arranged the lifting head for gripping a reel, c) the extension arm is dimensioned such that, in conjunction with the robot, which can be displaced in the longitudinal direction of the portal, a reel can be received from a pallet and transferred to in each case one associated winding subassembly outside the portal.

In the case of the invention, the regions where material is stored, on the one hand, and the reels are processed, on the other hand, are separated from one another in spatial terms, in which case it is possible to carry out necessary work on the winding subassemblies without impinging on the portal region for this purpose. Furthermore, positioning the winding subassemblies outside the portal allows the material webs to be guided in a novel manner in conjunction with the packaging machines being arranged to better effect in relation to the store or portal.

One special feature is constituted by measures which allow reels which are fed by a reel conveyor to be transferred to an operating spindle of a winding subassembly or of a packaging machine. According to the invention, the reels are deposited on an intermediate conveyor, which allows transfer to an upright operating spindle independently of the reel conveyor.

A further and special inventive feature is constituted by the design of a lifting head for a reel conveyor, in particular a robot. This special feature consists in the lifting head having two retaining mechanisms which are based on different methods of operation, namely, on the one hand, a transporting spindle which can be fixed in the central opening in the reel and, on the other hand, a suction mechanism, in particular a suction bell, which acts on the top side of the reel. Large-diameter and/or high-weight reels can thus be gripped and handled in a reliable manner.

BRIEF DESCRIPTION OF THE DRAWING FIGURES

Further details of the invention will be explained in more detail hereinbelow with reference to the drawings, in which.

DETAILED DESCRIPTION OF PREFERRED EMBODIMENTS

Figure 1:
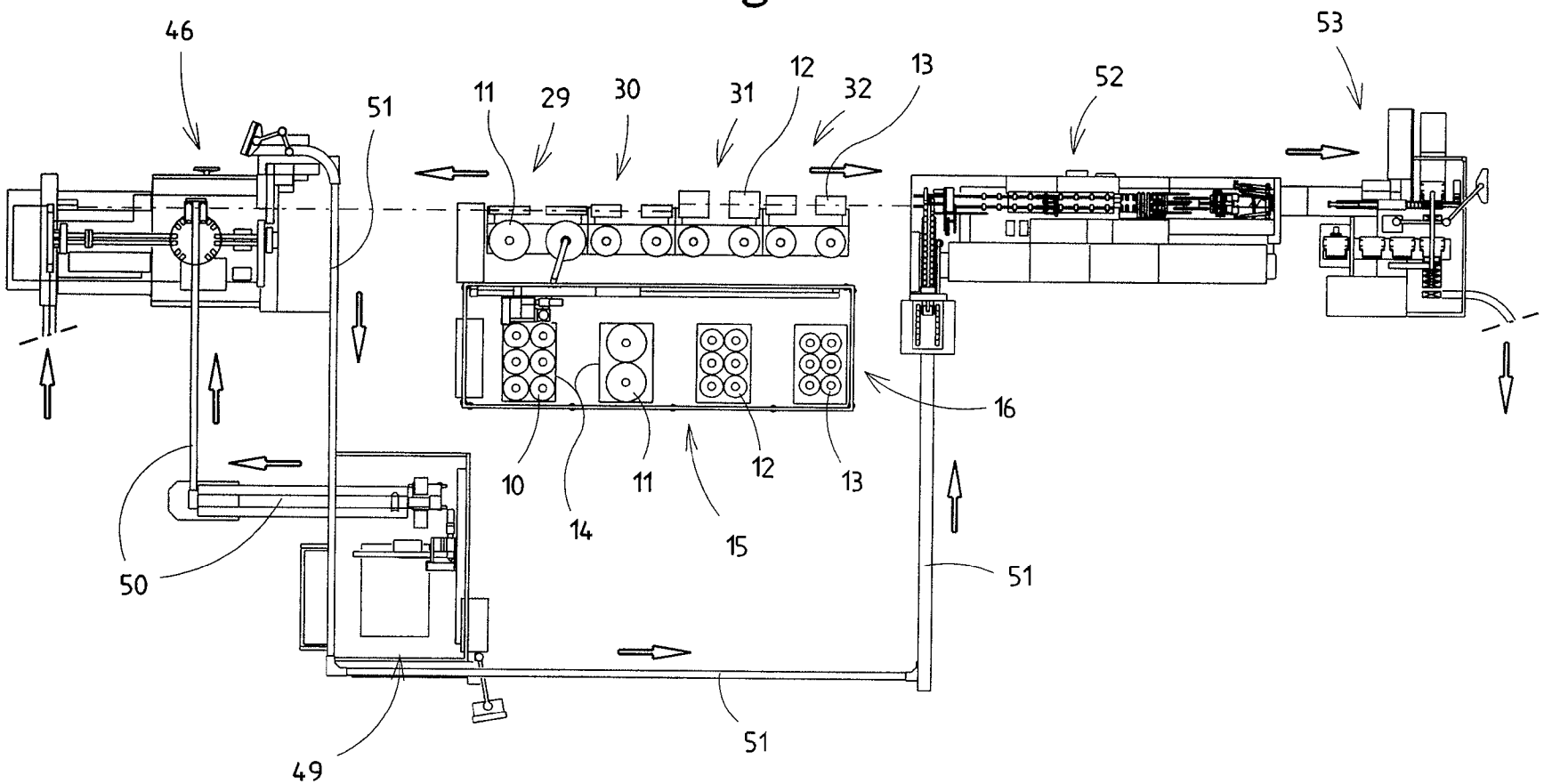
FIG. 1 shows a plan view of an installation for producing cigarette packs.

The drawings illustrate the handling of packaging material in conjunction with the production of packs, specifically the production of cigarette packs configured as hinge-lid boxes. The production of this classic type of cigarette pack requires the processing, on the one hand, of prefabricated blanks and, on the other hand, of web-like material. The handling of the material webs, which are available in the form of reels 10, 11, 12, 13, is very important. The reels 10 . . . 13, which differ in respect of materials and size, serve for producing different blanks of the packs. The reels 10 comprise tinfoil webs for an inner wrapper of the pack contents (alternatively made of paper). The reels 11 are intended for producing collars, and therefore consist of thin cardboard. The reels 12 are wound webs of paper or film for a wrapper of a (cigarette) multipack. Finally, the reels 13 comprise wound film webs (with tear-open threads) for an outer wrapper of the (individual) packs.

The reels 10 . . . 13 are sorted by type on pallets 14. Accordingly, each type of reel is assigned one pallet 14. A complete set of such pallets 14 is kept in the region of a reel store 15. The reel store 15 is enclosed by a portal 16, that is to say an essentially rectangular or cuboidal carrying framework. A top rectangular frame 17 rests on (four) corner supports 18 and intermediate supports 19 in accordance with static requirements. The rear intermediate supports 19 are arranged at regular intervals, in which case the pallets 14 can be fed, and placed in position, in the region of free interspaces.

For the purpose of handling or transporting the reels 10 . . . 13, use is made of a reel conveyor, namely of a portal robot 20. This is designed, and arranged, in a specific way. An upright robot column 21 can be displaced on the portal 16, in the longitudinal direction of the same. The portal robot 20 is arranged eccentrically, namely on a lateral longitudinal carrier 22 of the frame 17. A special travelling rail 23 is fitted on the inside of this longitudinal carrier, and a travelling mechanism of the portal robot 20 can be moved back and forth along this rail, to be precise by means of a stationary servomotor 24.

A lifting unit 25 can be moved up and down, likewise by means of a motor drive, on the robot column 21. A carrying unit for a lifting head 26 is fitted on the lifting unit 25. The carrying unit comprises a carrying arm which can be pivoted in a horizontal plane and is intended for the lifting head, to be precise configured as an articulated arm 27 with an approximately central joint. Accordingly, the lifting head 26 can be moved up and down and, on account of the pivotability of the articulated arm 27 and the additional movement component furnished by the joint, can be aligned precisely in a horizontal plane on the reel 10 . . . 13 which is to be handled in each case. The portal 16 is provided in the bottom region, at a distance from the floor, with a carrying unit which extends over three sides of the portal 16 and is intended to increase the stability. The portal robot, or the robot column 21 thereof, has its bottom region supported on a longitudinal profile 28 of the portal 16.

The reels 10 . . . 13, which are kept in the reel store 15, are to be transferred from the portal robot 20 to consuming machines, these being winding subassemblies 29, 30, 31, 32. These apparatuses, also referred to as splicers, serve for drawing off the material webs from the respective reels 10 . . . 13 and for feeding the webs directly to the respective packaging machines. Each winding subassembly 29 . . . 32 has at least two holders for reels 10 . . . 13, namely transversely projecting, horizontally directed operating spindles 33, 34. These each enter into a central opening 35 in the reel 10 . . . 13. The central opening 35 is usually formed by a sleeve-like, cylindrical reel core 36, onto which the respective material web is wound. Accordingly, each winding subassembly 29 . . . 32 is fitted with an active reel and a reserve reel. In order to attach the respectively new reel to the outgoing web, each winding subassembly 29 . . . 32 is provided with a splicing mechanism 37. One special feature is that all the winding subassemblies 29 . . . 32 are positioned outside the portal 16, to be precise in parallel alignment along a longitudinal side.

The winding subassemblies 29 . . . 32 are positioned outside the reel store 15, or outside the portal 16, so as to allow access in the region of the front side and of the rear side without impinging on the region of the portal 16 in the process. Furthermore, the relative positioning is selected, in conjunction with the dimensioning and movement capability of the portal robot 20, such that the lifting head 26 can grip each, reel 10 . . . 13 in the region of the portal 16 and transfer it to the respectively relevant winding subassembly 29 . . . 32. The pallets 14 are expediently positioned directly adjacent to the winding subassembly 29 . . . 32 which receives the relevant reels 10 . . . 13.

Figure 8:
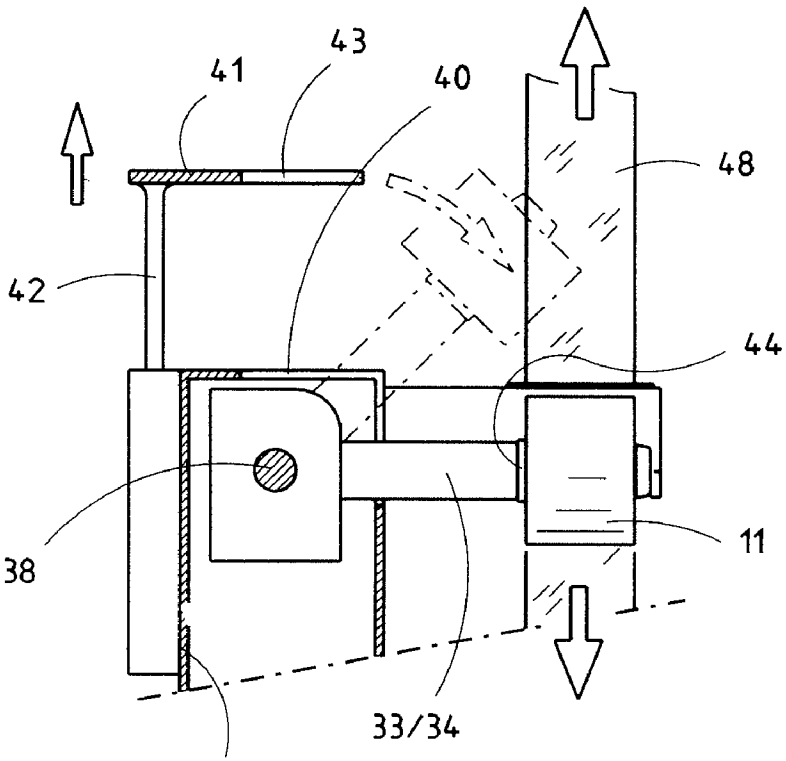
FIG. 8 shows the detail according to FIG. 7 with a mechanism in a different position.

One special feature is the transfer of the reels 10 . . . 13 from the reel conveyor, or from the lifting head 26, to a spindle or operating spindle 33, 34 of an apparatus which processes the respective material. The two operating spindles 33, 34 of each winding subassembly 29 . . . 32 are mounted in a pivotable manner, that is to say they can be tilted between a horizontal operating position (FIG. 8) and an upright receiving position. The two spindles 33, 34 of each winding subassembly 29 . . . 32 can be moved independently of one another and are each mounted for pivoting on a shaft 38. The drive and pivot bearings are located within a housing 39 with an opening 40 which extends around the corner and is intended for the through-passage of the operating spindle 33, 34 during final positioning and during pivoting.

Figure 7:
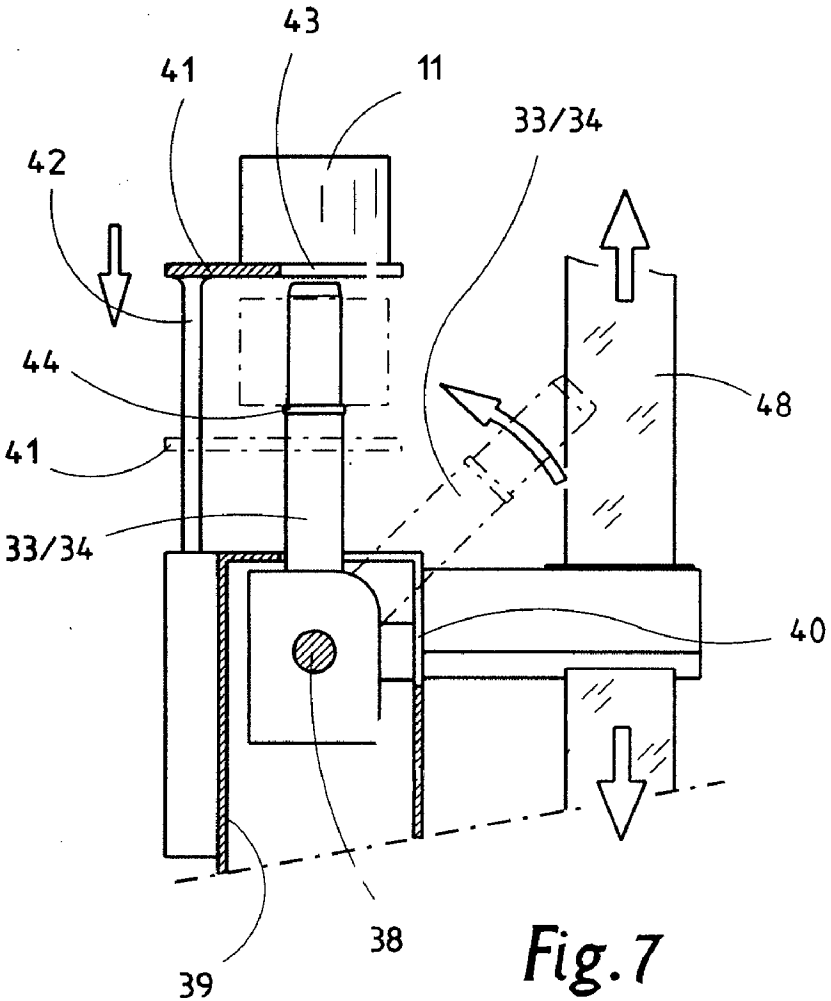
FIG. 7 shows a further detail of the station according to FIG. 5, this time in a cross section taken along section plane VII-VII from FIG. 5.

The reels 10 . . . 13 are fed as required to the winding subassemblies 29 . . . 32 and transferred in each case to an operating spindle 33, 34 in the upright position (FIG. 7). For this purpose, each operating spindle 33, 34 is assigned an intermediate conveyor for the reels 10 . . . 13. This conveyor receives the reel 10 . . . 13 from the lifting head 26 and transfers it to the respective upright operating spindle 33, 34. The intermediate conveyor is designed such that, once the reel 10 . . . 13 has been transferred to the operating spindle 33, 34, the latter can be pivoted into the horizontal operating position without being adversely affected by the separately movable intermediate conveyor. The latter is preferably designed as a carrying plate 41 and is arranged essentially centrally above the operating spindle 33, 34. Each carrying plate 41 can be moved, that is to say can be raised and lowered, independently. The carrying plate 41 is thus fitted on a lifting apparatus, in the present case on (two) lifting rods 42, which can be moved up and down, for example, by a pressure-medium cylinder.

Figure 5:
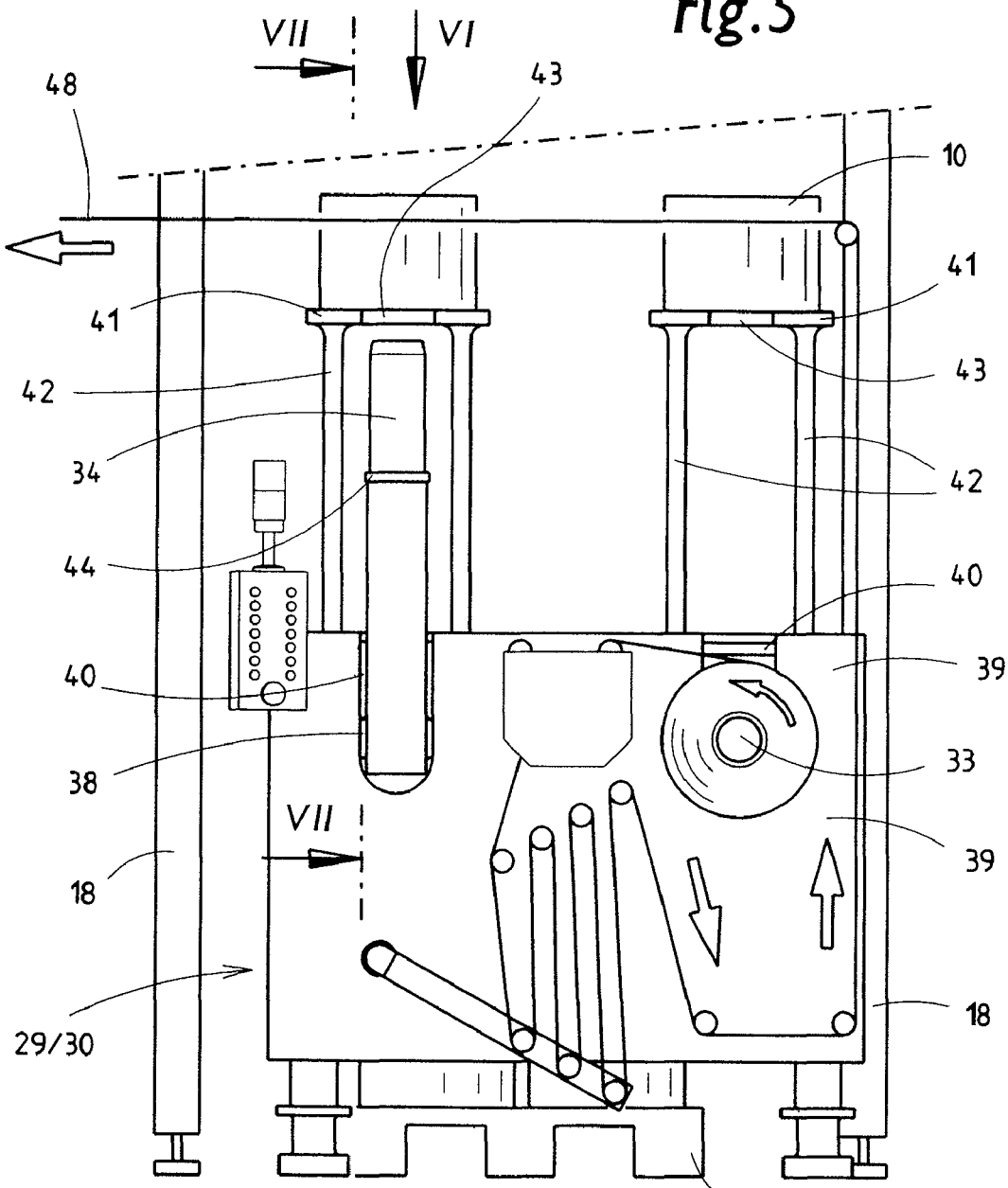
FIG. 5 shows, on an enlarged scale, a detail of the store according to FIGS. 2 to 4 in a front view according to FIG. 3.
Figure 6:
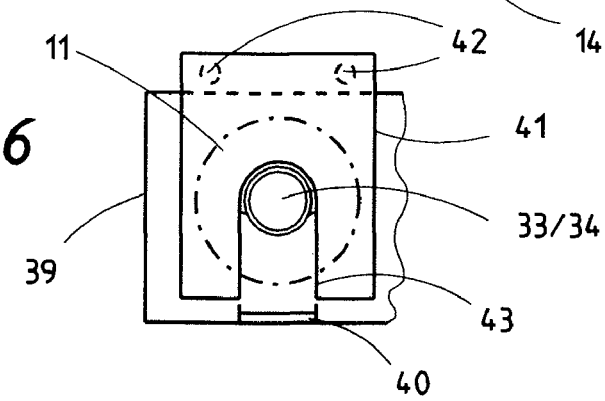
FIG. 6 shows a detail of a station of the store, namely of a winding subassembly, in a plan view corresponding to arrow VI in FIG. 5.

The respective reel 10 . . . 13 is deposited on the relevant carrying plate 41, by the lifting head 26, in a top receiving position (FIG. 5). For transfer to an upright operating spindle 33, 34, the carrying plate 41 is lowered. A central opening in the carrying plate 41, namely a slot 43 which is open in the direction of the pivoting movement of the operating spindle 33, 34, allows the reel 10 . . . 13 to be transferred to the operating spindle 33, 34 as a result of the lowering movement. The operating spindle 33, 34 here enters into the central opening 35 in the reel 10 . . . 13.

The intermediate conveyor or the carrying plate 41 is lowered relative to the operating spindle 33, 34 until the reel 10 . . . 13 comes into abutment against a stop on the operating spindle 33, 34, namely against a cross-sectional enlargement or against a collar 44. The latter is fitted such that, upon abutment against this stop, the reel assumes the precise operating position on the spindle. The intermediate conveyor or the carrying plate 41 is then freed from the reel on account of continued movement, namely by way of downward movement (FIG. 7, chain-dotted lines). The operating spindle 33, 34 is then moved, with the reel, into the horizontal operating position, the operating spindle 33, 34 being moved out of the region of the carrying plate 41 via the open side of the slot 43. This carrying plate can then be moved back into the top, starting or receiving position. Accordingly, the winding subassemblies 29 . . . 32 can be charged irrespective of the position of the operating spindles 33, 34, and this therefore results in particularly efficient material supply.

Figure 2:
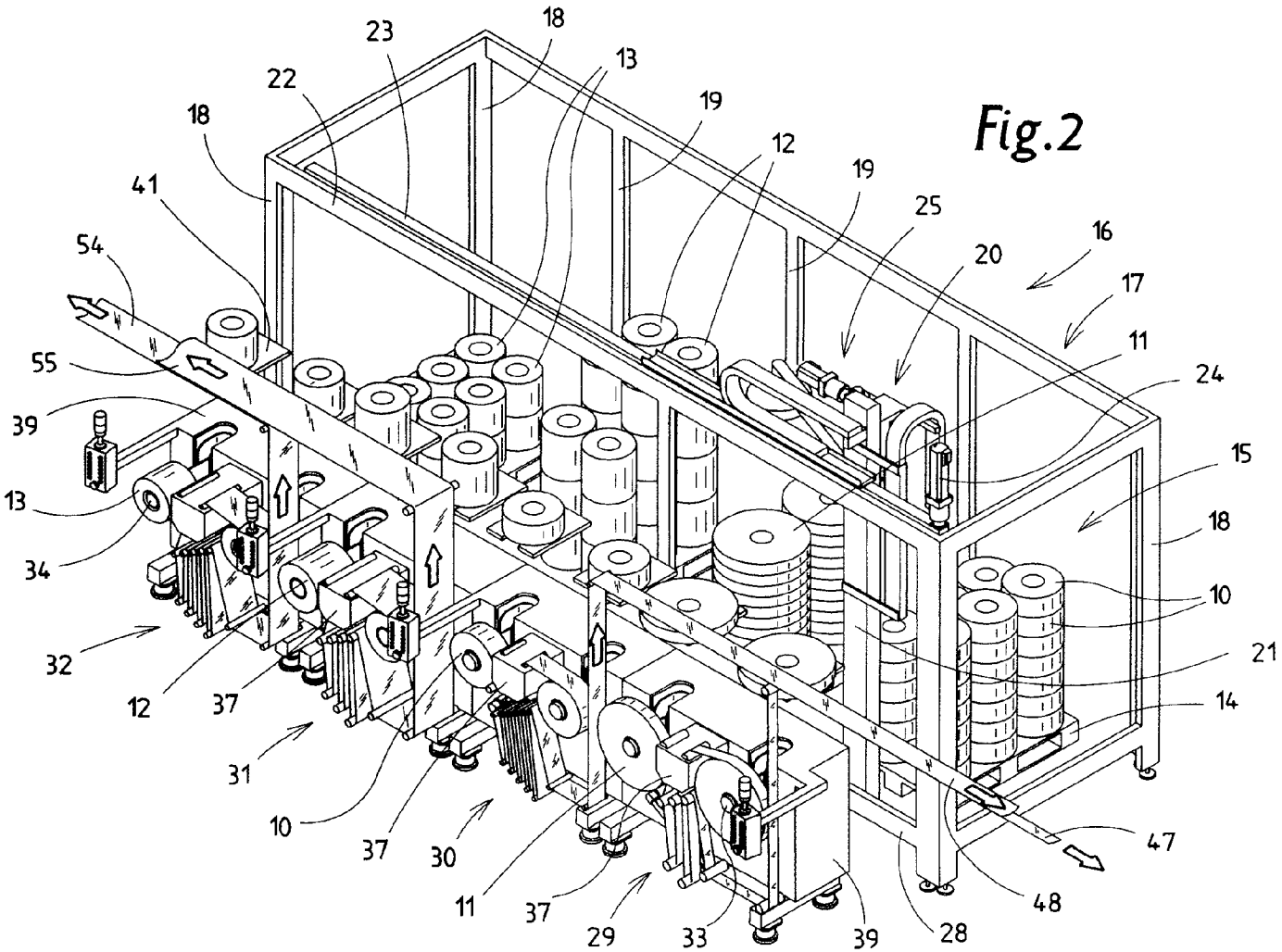
FIG. 2 shows a perspective illustration of a detail of the installation according to FIG. 1, namely of a material or reel store.
Figure 3:
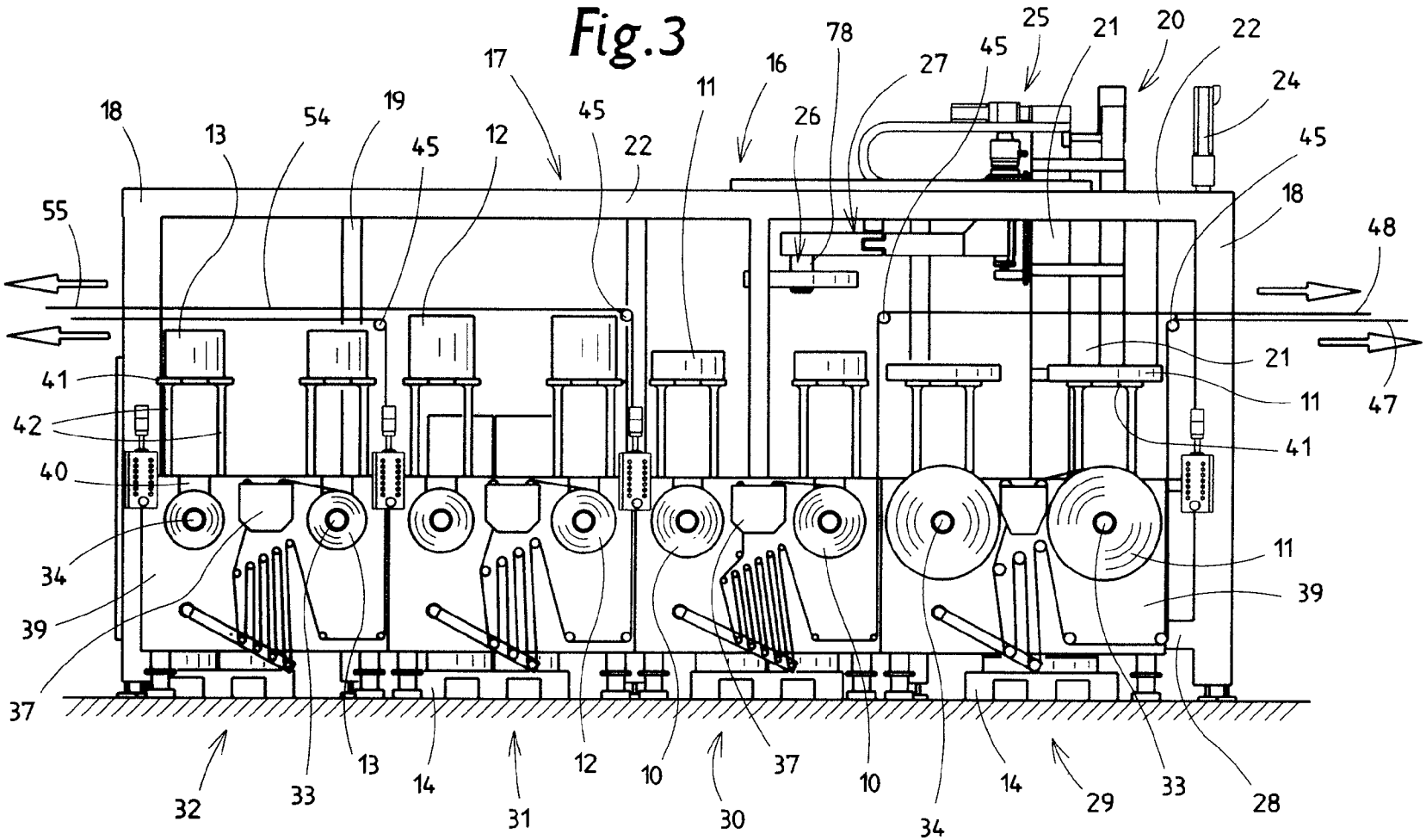
FIG. 3 shows a front view of the store according to FIG. 2.
Figure 4:
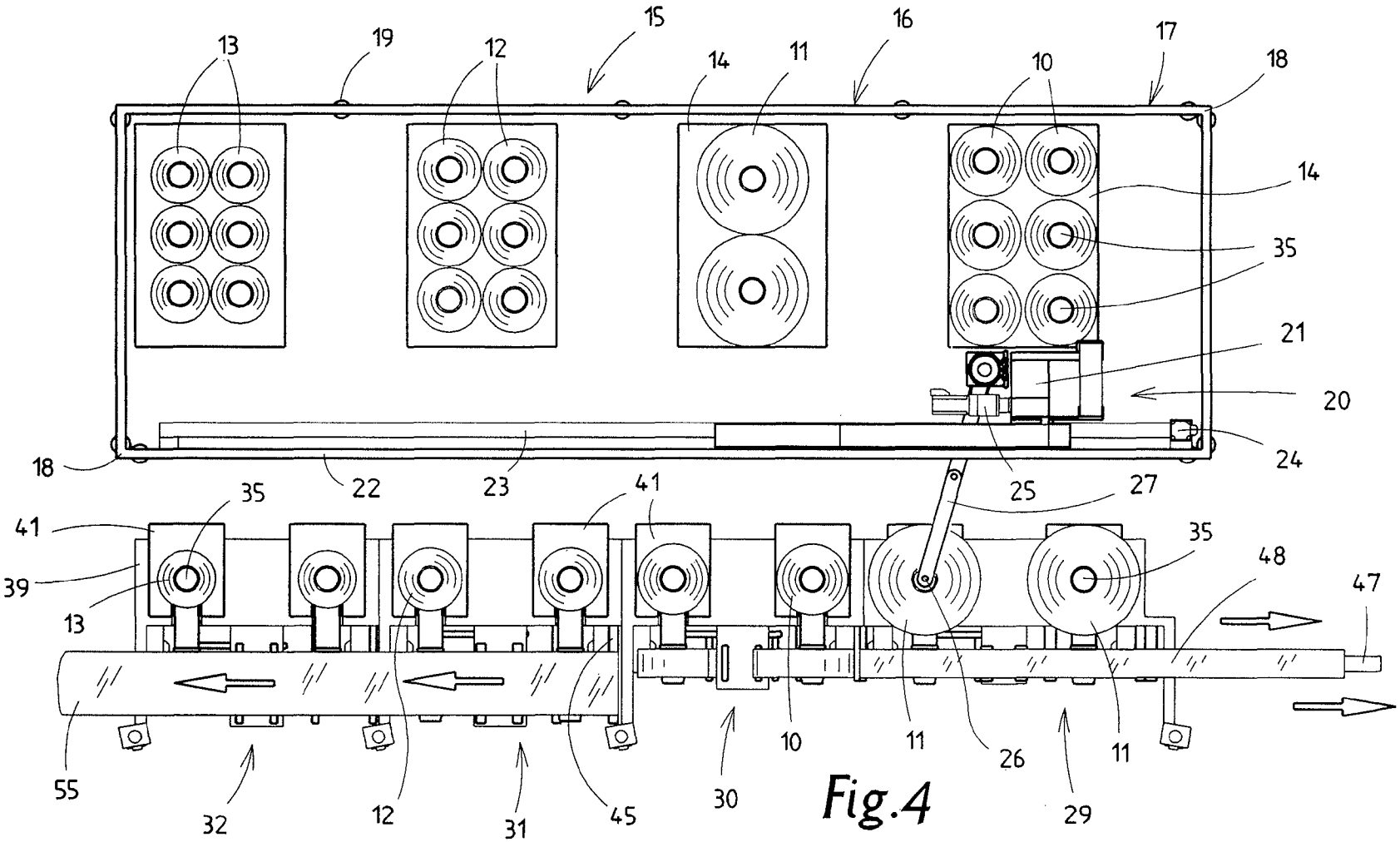
FIG. 4 shows a plan view of the store according to FIGS. 2 and 3.

Positioning the winding subassemblies 29 . . . 32 outside the portal 16 allows the material webs to be unwound from the reels 10 . . . 13 without being deflected "around the corner" directly toward consuming machines, namely packaging machines. Coming from the respective reel 10 . . . 13, the material webs are conveyed in an upright plane and are then deflected into a horizontal conveying plane by means of deflecting rollers 45. The deflecting rollers 45 assigned to each web are arranged in offset positions, in which case the webs can be transported away in vertically offset horizontal planes (FIGS. 2 and 3).

The abovementioned movement direction of the material webs makes it possible for the packaging machines to be positioned in a particular manner in relation to the reel store 15 or portal 16 (layout). As can be seen, in particular, from FIG. 1, material-consuming machines are arranged on both sides of the portal 16 or of the row of winding subassemblies 29 . . . 32. In the case of the present example, a packaging machine for producing cigarette packs, namely a hinge-lid packer 46 for producing hinge-lid packs, is positioned on the one side of the reel store 15. In accordance with the conventional construction of this type of pack, two material webs are fed to the hinge-lid packer 46. A comparatively narrow collar web 47 made of thin cardboard is drawn off from the reel 11 in the region of the (first) winding subassembly 29 and runs along a bottom conveying plane. A tinfoil web 48 is also guided to the hinge-lid packer 46, to be precise in the top plane, starting from the (second) winding subassembly 30 with the reels 10. On account of the relative positioning, the webs 47, 48 pass directly to the processing subassemblies of the hinge-lid packer 46.

Blanks for this type of pack are usually produced outside the packaging installation and are supplied on pallets in the form of stacks of blanks. A separate stacking station 49 processes this packaging material, by the stacks of blanks being set down on a stack conveyor 50 and transported to the hinge-lid packer 46. The latter is equipped in a conventional manner with a blank magazine, which receives the stacks of blanks for separation and transfer to a folding turret.

Coming from the hinge-lid packer 46, the finished cigarette packs bypass the reel store 15 and are fed to further packaging machines, to be precise by a pack conveyor 51, which is arranged in a U-shaped manner in plan view. This pack conveyor is designed as an overhead conveyor and transports the packs to a packing machine for the outer wrapper, namely to a cellophane packer 52. The latter applies an outer wrapper made of film to the packs coming from the hinge-lid packer 46. The packs completed in this way are transferred to a following multipacker 53 for producing (cigarette) multipacks. For this purpose, the multipacker 53 wraps a group of packs in a multipack blank made of paper or film.

The last-mentioned packers 52, 53 are assigned the winding subassemblies 31, 32. The material webs of the latter are conveyed in a direction counter to that in the winding subassemblies 29, 30. A film web 54 runs along a bottom plane and is drawn off from the (film) reel 13 of the peripheral winding subassembly 32. This film web 54 leads to the cellophane packer 52. The reels 12 for the multipack wrapper are kept in the region of the winding subassembly 31. Coming from a deflecting roller 45, a film or paper web 55 leads, in a plane above the film web 54, to the multipacker 53 and, in the process, is conveyed above the cellophane packer 52.

Figure 11:
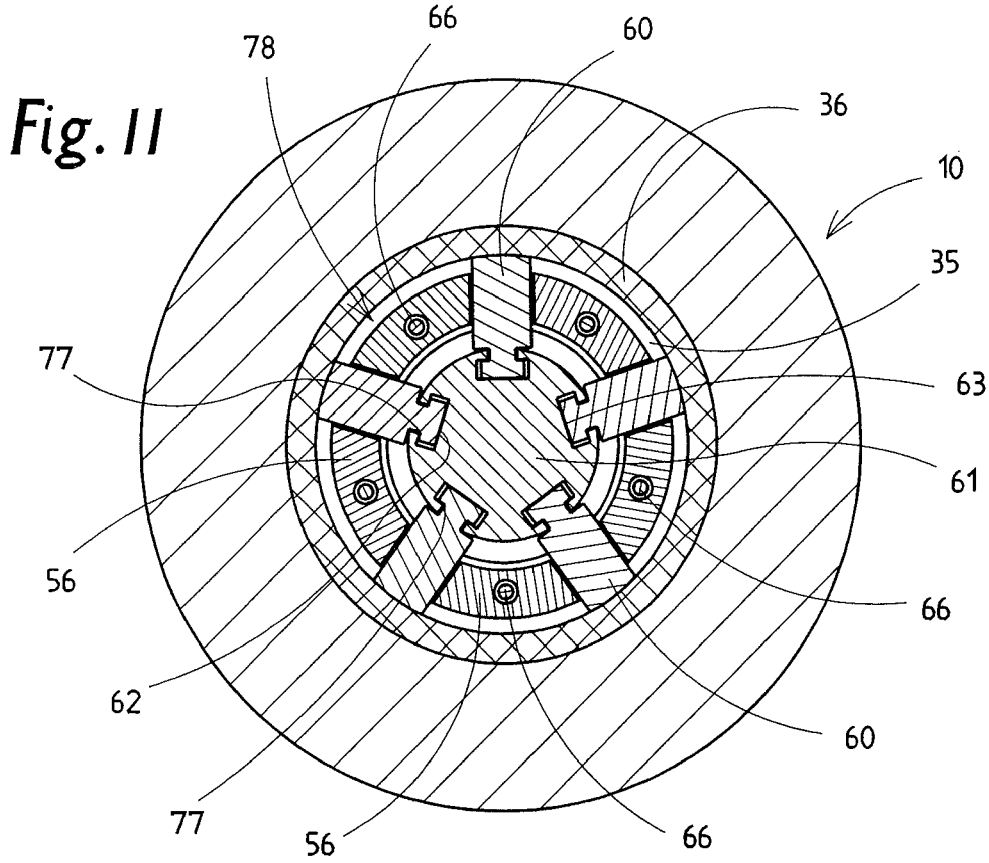
FIG. 11 shows a cross section of the lifting head according to FIG. 10 taken along section plane XI-XI.

A further special feature is constituted by the design of the lifting unit 25 or of the lifting head 26 for handling, that is to say for raising and transporting, reels having a central opening 35. The lifting head 26, which is fitted on a lifting unit, in this case on an articulated arm 27, has a spindle, namely a transporting or carrying spindle 78, which enters into the central opening 35 and is braced by clamping mechanisms within the central opening 35 or within the reel core 36. The cylindrical spindle 78 is in the form of a hollow body with an annular or cylindrical lateral surface 56. The latter is slightly smaller, in respect of external diameter, than the central opening 35. The lateral surface 56 is connected to a top carrying component, namely to a head plate 57. The latter is fitted on a carrying unit connected to the extension arm or articulated arm 27. This carrying unit is in the form of one or more carrying rods 58, 59. Clamping mechanisms, namely clamping jaws 60, which can be moved out in the transverse or radial direction are mounted within the carrying spindle 78. A plurality of, in the present case five, crosspiece-like clamping jaws 60 are distributed at equal intervals from one another in the circumferential direction of the spindle 78 (FIG. 11). In the clamping position, the clamping jaws 60 have their outer surfaces butting against the reel core 36.

A common actuating mechanism is assigned, within the spindle 78, to the plurality of clamping jaws 60. The actuating mechanism is a bracing cone 61, which is arranged such that it can be moved centrally within the lateral surface 56. The bracing cone 61 has an upwardly converging, that is to say obliquely directed bracing surface 62, against which the clamping jaws 60 butt by way of correspondingly inclined mating surfaces 63. As a result of upward movement of the centrally arranged bracing cone 61, the action of bracing surfaces 62 and mating surfaces 63 causes the clamping jaws 60 to move jointly in the radially outward direction into the clamping position. The clamping jaws 60 here pass through slot-like apertures 64 in the spindle or in the lateral surface 56. The bracing cone 61 is assigned an actuating mechanism, namely a pressure-medium cylinder 65 (short-stroke cylinder) which is arranged centrally above or on the head plate 57. This cylinder is connected to the bracing cone 61 via a piston rod and can be controlled for up and down movements of the bracing cone 61. The (five) clamping jaws 60, which are spaced apart from one another at equal angular intervals, are connected to the bracing cone 61, in particular by means of a dovetail guide 77, relative movement being ensured in the process.

The spindle or carrying spindle 78 gives rise to a weight-dependent increase in clamping force on the clamping jaws 60. For this purpose, the lateral surface 56 is connected to the head plate 57 (indirectly) as a separate workpiece under elastic pressure. A plurality of spaced-apart carrying bolts 66 are guided in corresponding bores in the lateral surface 56. These carrying bolts are fixed to the head plate 57. The lateral surface 56 rests on springs 67, which are supported on a bottom end stop 68 of each carrying bolt 66. In the case of the lateral surface 56 being subjected to increased loading in the downward direction, it is moved downward relative to the head plate 57, with the spring 67 being compressed in the process. Since the relative positioning of the bracing cone 61 remains unchanged, the downward movement of the lateral surface 56 results in an increase in pressure in the region of the surfaces 62, 63 and thus in an increase in the clamping force, initiated by the weight of the reel.

Figure 9:
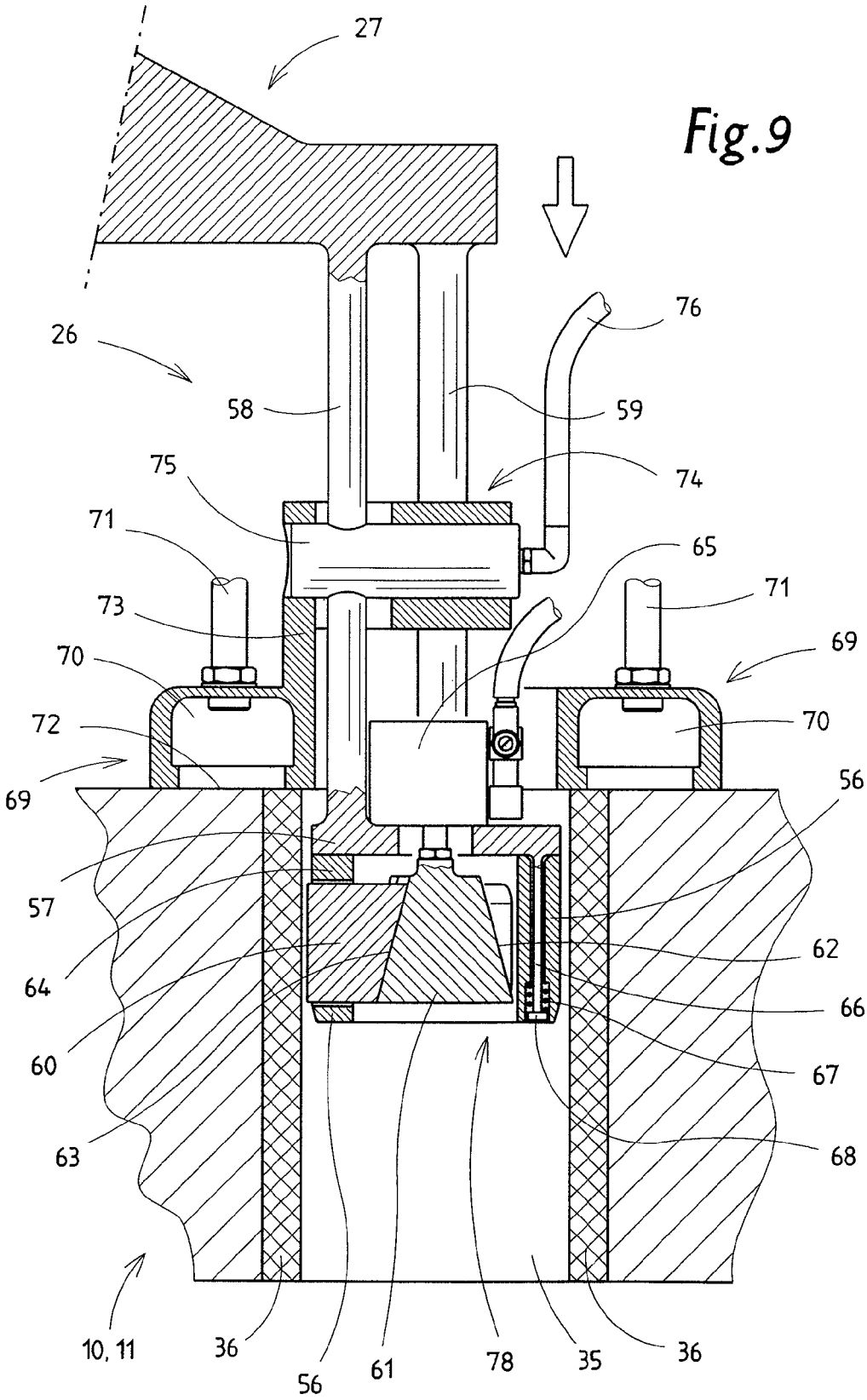
FIG. 9 shows a vertical section of a further detail of the reel store, namely a lifting head of a reel conveyor.

A further special feature is constituted by the design of the lifting head 26 with a second, independent lifting means. This is a suction mechanism, namely an annular suction bell 69. The latter comprises a hollow body which is open in the downward direction and is set down on a top side of the reel 10 . . . 13 which is to be handled. The suction bell 69 is fixed on the reel by means of negative pressure. For this purpose, the suction bell 69 is in the form of an annular hollow body. An interior chamber 70 is attached to a suction line 71, which leads to a negative-pressure source. A plurality of, at least two, such suction lines 71 are provided in order to generate a sufficient negative pressure in the interior chamber 70. The annular suction bell 69 is dimensioned such that a downwardly directed suction opening 72 has a sub-region also covering the reel core 36 (FIG. 9).

The suction bell 69 can be moved up and down, as an additional lifting means, relative to the carrying spindle 78. For this purpose, the suction bell 69 is connected to a guide component 74 via a connection 73. The guide component can be pushed up and down on a rod, mainly on the carrying rod 59, with the suction bell 69 being carried along in the process. The latter can be fixed in any desired position relative to the carrying spindle 78, to be precise by a clamping mechanism 75. The latter is a clamping cartridge which can be fixed on a counterpart by means of compressed air. The compressed air is fed via a line 76. The clamping mechanism 75 is mounted on the carrying rod 58 and can be fixed on the latter in any desired position, as a result of which a corresponding position of the suction bell 69 is defined.

Figure 10:
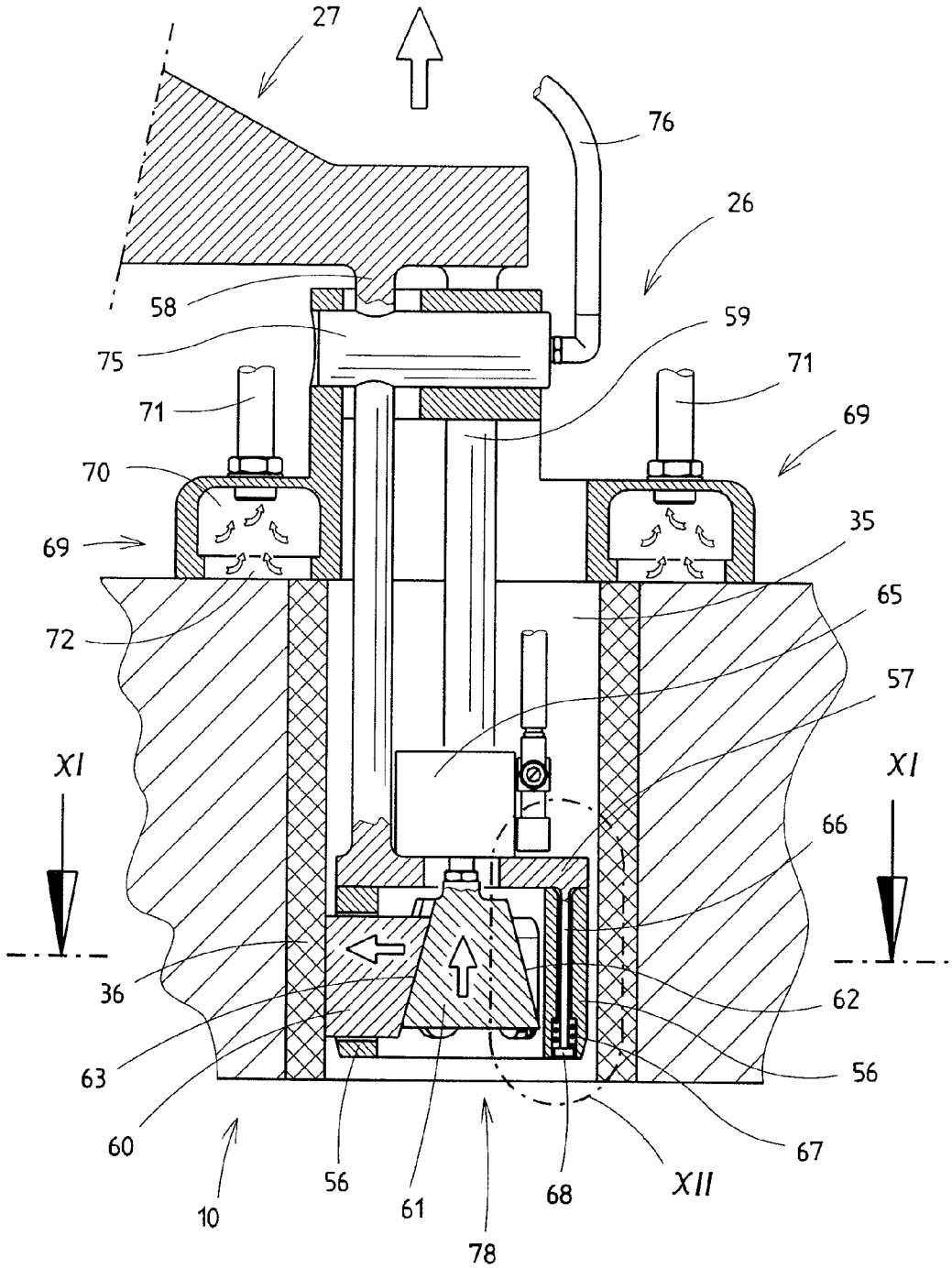
FIG. 10 shows the detail according to FIG. 9 with mechanisms of the lifting head in different positions relative to one another.
Figure 12:
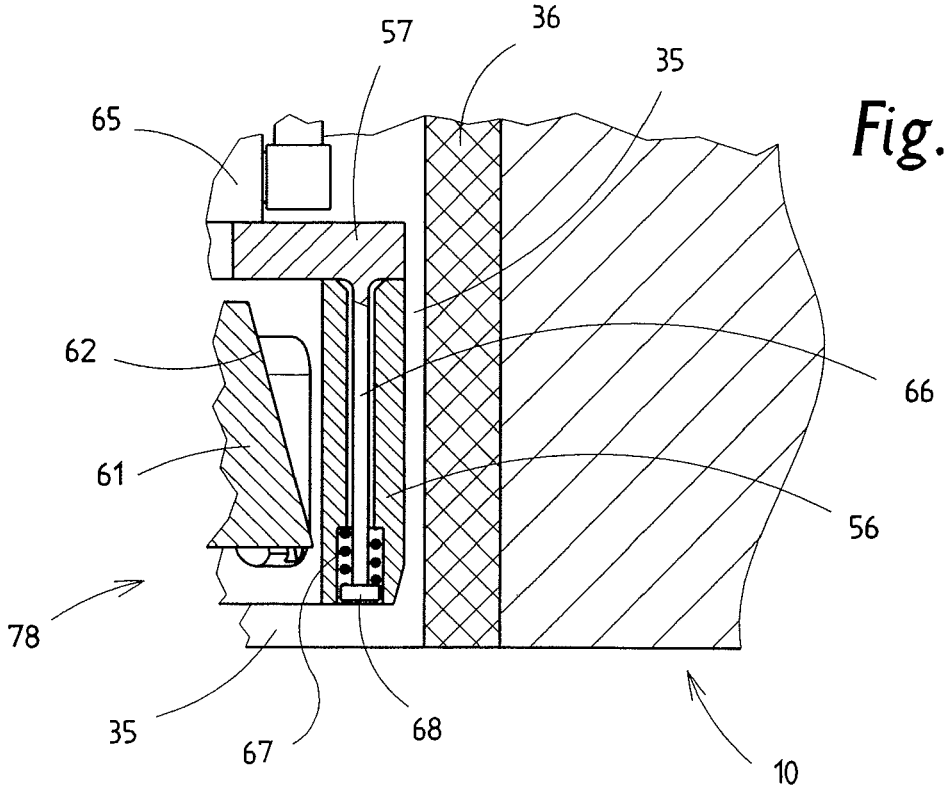
FIG. 12 shows, on an enlarged scale, a detail XII of the lifting head according to FIG. 10.

When use is made of the combined lifting head 26 which is formed in this way, the spindle 78 is introduced into the central opening 35, to be precise preferably into a bottom region (FIG. 10). In this position, the clamping jaws 60 are moved out in order to fix the spindle 78. With the clamping mechanism 75 relieved of stressing, the suction bell 69 is located on the top side of the reel (FIG. 9). With continued introduction of the spindle 78, the guide component 74 slides downward on the carrying rod 59. If the spindle 78 has reached the clamping position, and is fixed, the clamping mechanism 75 is actuated and the suction bell 69 is thus fixed in the position for gripping the reel 10 . . . 13 by means of suction air, that is to say in the abutment position according to FIG. 10. The suction bell 69 is then subjected to negative pressure, in which case, when the reel 10 . . . 13 is raised, carrying force is transmitted both within the reel core 36 and onto the top side of the reel. The lifting head 26 which is formed in this way can be used in the case of any desired mechanisms for lifting reels.

The system or installation which has been illustrated and described is also suitable, with analogous changeover and adaptation, for the production of other types of pack, in particular cigarette packs in the form of soft-carton packs or packs of the shell and slide type.

LIST OF DESIGNATIONS

10 (Collar) reel
11 (Tinfoil) reel
12 (Multipack) reel
13 (Film) reel
14 Pallet
15 Reel store
16 Portal
17 Frame
18 Corner support
19 Intermediate support
20 Portal robot
21 Robot column
22 Longitudinal carrier
23 Travelling rail
24 Servomotor
25 Lifting unit
26 Lifting head
27 Articulated arm
28 Longitudinal profile
29 Winding subassembly
30 Winding subassembly
31 Winding subassembly
32 Winding subassembly
33 Operating spindle
34 Operating spindle
35 Central opening
36 Reel core
37 Splicing mechanism
38 Shaft
39 Housing
40 Opening
41 Carrying plate
45 Deflecting roller
46 Hinge-lid packer
47 Collar web
48 Tinfoil web
49 Stacking station
50 Stack conveyor
51 Pack conveyor
52 Cellophane packer
53 Multipacker
54 Film web
55 Paper web
56 Lateral surface
57 Head plate
58 Carrying rod
59 Carrying rod
60 Clamping jaw
61 Bracing cone
62 Bracing surface
63 Mating surface
64 Aperture
65 Pressure-medium cylinder
66 Carrying bolt
67 Spring
68 End stop
69 Suction bell
70 Interior chamber
71 Suction line
72 Suction opening
73 Connection
74 Guide component
75 Clamping mechanism
76 Line
42 Lifting rod

43 Slot
44 Collar
77 Dovetail guide
78 Carrying spindle

The invention claimed is:

1. A system for supplying packaging machines for the production of cigarette packs or similar packs with consumable material selected from the group consisting of webs of paper, thin cardboard, film, and tinfoil, which is wound in the form of reels (10, 11, 12, 13), comprising:

a) pallets on which the reels (10 . . . 13) of a single type are kept ready at a reel store (15), b) a portal (16) bounding the reel store (15), which portal is formed by at least four upright supports (18, 19) and a top horizontal frame (17) with longitudinal carriers (22) held by the supports (18, 19), c) a portal robot for transporting the reels (10 . . . 13), which are kept ready on the pallets (14) at the reel store (15) and within the portal (16), the portal robot (20) having a lifting head (26) for gripping one reel (10 . . . 13) at a time, wherein the portal robot (20) is displaceable along the full length of the longitudinal carriers (22) in the longitudinal direction of the frame (17), d) a plurality of winding subassemblies (29 . . . 32), wherein the portal robot (20) feeds the reels (10 . . . 13) received from the pallets (14) to a respective one of the plurality of winding subassemblies (29 . . . 32), which have, for the purpose of unwinding the reel (10 . . . 13), operating spindles (33, 34) for receiving a respective one of the reels (10 . . . 13) to be unwound, wherein the respective unwound web of packaging material is fed to a packaging machine, and wherein the winding subassemblies (29 . . . 32) are located completely outside of the portal (16) and are positioned vertically next to one another adjacent to a longitudinal side of an adjacent one of the winding subassemblies (29 . . . 32), and e) an extension arm or articulated arm (27) disposed on the portal robot (20), the extension arm or articulated arm (27) being pivotable in a horizontal plane and being disposed on the portal robot (20) to move upwards and downwards, and the lifting head (26) for gripping one of the reels (10 . . . 13) is located at the free end of the extension arm or articulated arm (27), wherein the extension arm or articulated arm (27) is dimensioned such that, in conjunction with the portal robot (20), which is displaceable in the longitudinal direction of the portal (16), one of the reels (10 . . . 13) is received from the pallet (14) and transferred to one of the plurality of winding subassemblies (29 . . . 32) outside the portal (16), the extension arm or articulated arm (27) is moved up and down on an upright robot column (21) of the portal robot (20), the robot column (21) is displaced on the longitudinal carrier (22), which is directed toward the winding subassemblies (29 . . . 32) and forms part of the portal (16), in the direction of the longitudinal carrier, the portal robot (20) sets the reels (10 . . . 13) down on a carrying plate (41), which can be moved up and down as an intermediate carrier, with a central opening (35) of the reel (10 . . . 13) being vertical, and, by way of downward movement of the carrying plate (41), the reels (10 . . . 13) are transferred to the operating spindle (33, 34) positioned in an upright receiving position, each of the winding subassemblies (29 . . . 32) has at least two operating spindles (33, 34) for each of the reels (10, 13), the operating spindles (33, 34) being spaced apart from each other, each of the operating spindles (33, 34) is pivotable independently about a horizontal axis, between a horizontal operating position and an upright receiving position in order to receive the reel (10 . . . 13) from the intermediate carrier or from the carrying plate (41), the reel (10 . . . 13) is positioned on the carrying plate (41) with a vertical central opening (35) and is set down on the operating spindle (33, 34), which is in an upright position, by the downward movement of the carrying plate (41), after transfer of the reel (10 . . . 13), the carrying plate (41) is moved away from the carrying spindle (33, 34) such that the carrying spindle is pivotable with the reel (10 . . . 13) into the horizontal operating position, the carrying plate (41) has an opening, configured as a slot (43), which corresponds with the central opening (35) of the reel (10 . . . 13), the slot (43) is open in the direction of the pivoting movement of the operating spindle (33, 34) from the upright position into the horizontal operating position so that the operating spindle (33, 34) is movable into the horizontal operating position without impinging the carrying plate (41) with the reel (10 . . . 13), the reel (10 . . . 13) is set down, by the downward movement of the carrying plate (41), on a protrusion or collar (44) of the operating spindle (33, 34) in accordance with the operating position of the reel (10 . . . 13), the carrying plate (41) is movable further downward such that the reel (10 . . . 13) rests exclusively on the operating spindle (33, 34), and once the operating spindle (33, 34) is pivoted into the operating position, the carrying plate (41) is returnable, by way of upward movement, into a top, receiving position for a reel (10 . . . 13).

2. The system as claimed in claim 1, wherein the upright robot column (21) of the portal robot (20) is displaceable on the longitudinal carrier (22), which is directed toward the winding subassemblies (29 . . . 32) and forms part of the portal (16), in the direction of the longitudinal carrier (22) while being supported on a bottom longitudinal profile (28).

3. The system as claimed in claim 1, wherein:

a) at the winding subassemblies (29 . . . 32), the material webs are wound off the reels (10 . . . 13) in a direction parallel to the longitudinal extent of the portal (16), which is parallel to the longitudinal carriers (22), b) the material webs drawn off the reels (10 . . . 13) are fed to the packaging machines in groups or in pairs moving in opposite directions, c) the material webs drawn off of the reels run at the winding subassemblies (29 . . . 32) first in an upright plane and then, on account of deflection in the region of a deflecting roller (45), in a horizontal plane, and d) the material webs that are transported in the same direction are guided in offset conveying planes that are located one above the other.

4. The system as claimed in claim 1, wherein:

a) for the production of cigarette packs of a hinge-lid-box type from separately produced blanks, a separate material store for stacks of blanks is arranged adjacent to a packaging machine (46), b) the material store has a stacking station (49) for transferring stacks of blanks to the packaging machine (46), and c) the packs that are produced by the packaging machine (46) are fed by a pack conveyor (51) outside the region of the reel store (15) to a cellophane packer (52).

5. The system as claimed in claim 1, wherein:

a) the lifting head (26) has a downwardly directed, vertical transporting or carrying spindle (78) for entering into a central opening (35) of the reel (10 . . . 13), b) the carrying spindle (78) comprises a cylindrical lateral surface (56), c) arranged inside the cylindrical lateral surface (56) are clamping jaws (60), which are movable radially or transversely to butt against an inner side of a reel core (36) forming the central opening (35), d) the clamping jaws (60) are movable outwardly by a central bracing cone (61), which is movable up and down, with bracing surfaces (62) and mating surfaces (63) interacting, e) the clamping jaws (60) are connected to the lateral surface (56) and are mounted in a displaceable manner in a respective aperture (64) of the lateral surface (56), and f) on account of being subjected to loading by a reel (10), the lateral surface (56) is movable downward relative to the bracing cone (61) such that the bracing forces of the clamping jaws (60) are increased due to the movement relative to the bracing cone (61).

6. The system as claimed in claim 5, wherein the clamping jaws (60) are connected to the bracing cone (61) in a form-fitting manner, but such that they are movable relative to one another via a dovetail connection (77) which is directed obliquely in a manner corresponding to the bracing surfaces (62) and mating surfaces (63).

7. The system as claimed in claim 5, wherein:

a) the lateral surface (56) of the carrying spindle (78) is movable in a vertical direction relative to a top, transversely directed carrying or head plate (57), b) the head plate (57) is connected by means of one or more carrying rods (58, 59) to the articulated arm (27), c) the lateral surface (56), which is designed in the form of a sleeve, is connected to the head plate (57) via upright carrying bolts (66), and d) the lateral surface (56) is supported elastically on springs (67), which are arranged on the carrying bolts (66), and pushed against the head plate (57) in the starting position.

8. The system as claimed in claim 1, wherein:

a) the lifting head (26) of the portal robot (20) has a transporting or carrying spindle (78) for entering into a central opening (35) in the reel (10 . . . 13), b) as a further carrying mechanism for gripping and retaining the reel (10 . . . 13), the lifting head (26) has a pneumatic lifting mechanism configured as a suction bell (69), which is fixed by means of negative pressure on a top side of the reel (10 . . . 13), c) the suction bell (69) is of annular design for gripping the reel (10 . . . 13) in a region concentric to the central opening (35), d) the suction bell (69) is mounted on the carrying rod (58) such that the suction bell is adjustable relative to the carrying spindle (78), e) the suction bell (69) is arranged on the guiding or carrying rod (58), which is upright and serves as a connection between the reel conveyor, or an extension arm of the same, and the carrying spindle (78), f) the suction bell (69) is fixed to the guiding or carrying rod (58) in any desired position relative to the carrying spindle (78), and g) the suction bell (69) is guided on the carrying rod (58) by a clamping mechanism (75) and is fixed to the carrying rod (58) by actuation of the clamping mechanism (75).

9. A system for supplying packaging machines for the production of cigarette packs or similar packs with consumable material selected from the group consisting of webs of paper, thin cardboard, film, and tinfoil, which is wound in the form of reels (10, 11, 12, 13), comprising:

a) pallets (14) on which the reels (10 . . . 13) of a single type are kept ready (14) in the region of a reel store (15), b) a portal (16) bounding the reel store (15), which portal is formed by at least four upright supports (18, 19) and a top horizontal frame (17) with longitudinal carriers (22) held by the supports (18, 19), c) a portal robot (20) for transporting the reels (10 . . . 13), which are kept ready on the pallets (14) in the region of the reel store (15) and within the portal (16), the portal robot (20) having a lifting head (26) for gripping one reel (10 . . . 13) at a time, wherein the portal robot (20) is displaceable along the full length of the longitudinal carriers (22) in the longitudinal direction of the frame (17), d) a plurality of winding subassemblies (29 . . . 32), wherein the portal robot (20) feeds the reels (10 . . . 13) received from the pallets (14) to a respective one of the plurality of winding subassemblies (29 . . . 32), which have, for the purpose of unwinding a respective one of the reels (10 . . . 13), operating spindles (33, 34) for receiving the respective one of the reels (10 . . . 13) to be unwound, wherein the respective unwound web of packaging material is fed to the packaging machine, and wherein the winding subassemblies (29 . . . 32) are located completely outside the region of the portal (16) and are positioned vertically next to one another adjacent to a longitudinal side of an adjacent one of the winding subassemblies (29 . . . 32), e) an extension arm or articulated arm (27) disposed on the portal robot (20), the extension arm or articulated arm (27) being pivotable in a horizontal plane and being disposed on the portal robot (20) to move upwards and downwards, and the lifting head (26) for gripping one of the reels (10 . . . 13) is located at the free end of the extension arm or articulated arm (27), wherein the extension arm or articulated arm (27) is dimensioned such that, in conjunction with the portal robot (20), which is displaceable in the longitudinal direction of the portal (16), one of the reels (10 . . . 13) is received from the pallet (14) and transferred to one of the plurality of winding subassemblies (29 . . . 32) outside the portal (16), f) an intermediate carrier associated with each of the winding subassemblies (29 . . . 32), wherein the reel (10 . . . 13) that is received and transported by the portal robot (20) or the lifting head (26) is set down on the intermediate carrier, and g) a carrying mechanism or a carrying plate (41) on the intermediate carrier, wherein the carrying mechanism or the carrying plate (41) is movable up and down, and on which the reel (10 . . . 13) with a vertical central opening (35) is set down by the lifting head (26), wherein the reel (10 . . . 13) is set down by the carrying mechanism or the carrying plate (41) by way of downward movement on an upwardly directed operating spindle (33, 34) of the winding subassembly (29, 32), and wherein the operating spindle (33, 34) is pivotable from an upright position with the reel (10 . . . 13) into a horizontal operating position, wherein i) each of the winding subassemblies (29 . . . 32) has at least two operating spindles (33, 34) for each of the reels (10, 13), the operating spindles (33, 34) being spaced apart from each other, ii) each of the operating spindles (33, 34) is pivotable independently about a horizontal axis, between a horizontal operating position and an upright receiving position in order to receive the reel (10 . . . 13) from the intermediate carrier or from the carrying plate (41), iii) the reel (10 . . . 13) is positioned on the carrying plate (41) with a vertical central opening (35) and is set down on the operating spindle (33, 34), which is in an upright position, by the downward movement of the carrying plate (41), iv) after transfer of the reel (10 . . . 13), the carrying plate (41) is moved away from the carrying spindle (33, 34) such that the carrying spindle (33, 34) is pivotable with the reel (10 . . . 13) into the horizontal operating position, v) the carrying plate (41) has an opening, configured as a slot (43), which corresponds with the central opening (35) of the reel (10 . . . 13), and vi) the slot (43) is open in the direction of the pivoting movement of the operating spindle (33, 34) from the upright position into the horizontal operating position so that the operating spindle (33, 34) is movable into the horizontal operating position without impinging the carrying plate (41) with the reel (10 . . . 13).

10. The system as claimed in claim 9, wherein:

a) the reel (10 . . . 13) is set down, by the downward movement of the carrying plate (41), on a protrusion or collar (44) of the operating spindle (33, 34) in accordance with the operating position of the reel (10 . . . 13), b) the carrying plate (41) is movable further downward such that the reel (10 . . . 13) rests exclusively on the operating spindle (33, 34), and c) once the operating spindle (33, 34) is pivoted into the operating position, the carrying plate (41) is returnable, by way of upward movement, into a top, receiving position for a reel (10 . . . 13).

11. The system as claimed in claim 9, wherein:

a) at the winding subassemblies (29 . . . 32), the material webs are wound off the reels (10 . . . 13) in a direction parallel to the longitudinal extent of the portal (16), which is parallel to the longitudinal carriers (22), b) the material webs drawn off the reels (10 . . . 13) are fed to the packaging machines in groups or in pairs moving in opposite directions, c) the material webs drawn off of the reels run at the winding subassemblies (29 . . . 32) first in an upright plane and then, on account of deflection in the region of a deflecting roller (45), in a horizontal plane, and d) the material webs that are transported in the same direction are guided in offset conveying planes that are located one above the other.

12. The system as claimed in claim 9, wherein:

a) for the production of cigarette packs of a hinge-lid-box type from separately produced blanks, a separate material store for stacks of blanks is arranged adjacent to a packaging machine (46), b) the material store has a stacking station (49) for transferring stacks of blanks to the packaging machine (46), and c) the packs that are produced by the packaging machine (46) are fed by a pack conveyor (51) outside the reel store (15) to a cellophane packer (52).

13. The system as claimed in claim 9, wherein:

a) the lifting head (26) has a downwardly directed, vertical transporting or carrying spindle (78) for entering into a central opening (35) of the reel (10 . . . 13), b) the carrying spindle (78) comprises a cylindrical lateral surface (56), c) arranged inside the cylindrical lateral surface (56) are clamping jaws (60), which are movable radially or transversely to butt against an inner side of a reel core (36) forming the central opening (35), d) the clamping jaws (60) are movable outwardly by a central bracing cone (61), which is movable up and down, with bracing surfaces (62) and mating surfaces (63) interacting, e) the clamping jaws (60) are connected to the lateral surface (56) and are mounted in a displaceable manner in a respective aperture (64) of the lateral surface (56), and f) on account of being subjected to loading by the reel (10), the lateral surface (56) is movable downward relative to the bracing cone (61) such that the bracing forces of the clamping jaws (60) are increased due to the movement relative to the bracing cone (61).

14. The system as claimed in claim 13, wherein the clamping jaws (60) are connected to the bracing cone (61) in a form-fitting manner, but such that they are movable relative to one another via a dovetail connection (77) which is directed obliquely in a manner corresponding to the bracing surfaces (62) and mating surfaces (63).

15. The system as claimed in claim 13, wherein:

a) the lateral surface (56) of the carrying spindle (78) is movable in a vertical direction relative to a top, transversely directed carrying or head plate (57), b) the head plate (57) is connected by means of one or more carrying rods (58, 59) to the articulated arm (27), c) the lateral surface (56), which is designed in the form of a sleeve, is connected to the head plate (57) via upright carrying bolts (66), and d) the lateral surface (56) is supported elastically on springs (67), which are arranged on the carrying bolts (66), and pushed against the head plate (57) in the starting position.

16. The system as claimed in claim 9, wherein:

a) the lifting head (26) of the portal robot (20) has a transporting or carrying spindle (78) for entering into a central opening (35) in the reel (10 . . . 13), b) as a further carrying mechanism for gripping and retaining the reel (10 . . . 13), the lifting head (26) has a pneumatic lifting mechanism configured as a suction bell (69), which is fixed by means of negative pressure on a top side of the reel (10 . . . 13), c) the suction bell (69) is of annular design for gripping the reel (10 . . . 13) in a region concentric to the central opening (35), d) the suction bell (69) is mounted on the carrying rod (58) such that the suction bell is adjustable relative to the carrying spindle (78), e) the suction bell (69) is arranged on the guiding or carrying rod (58), which is upright and serves as a connection between the reel conveyor, or an extension arm of the same, and the carrying spindle (78), f) the suction bell (69) is fixed to the guiding or carrying rod (58) in any desired position relative to the carrying spindle (78), and g) the suction bell (69) is guided on the carrying rod (58) by a clamping mechanism (75) and is fixed to the carrying rod (58) by actuation of the clamping mechanism (75).

17. A system for supplying packaging machines for the production of cigarette packs or similar packs with consumable material selected from the group consisting of webs of paper, thin cardboard, film, and tinfoil, which is wound in the form of reels (10, 11, 12, 13), comprising:

a) storing the reels (10 . . . 13) of a single type inside a reel store (15) on pallets (14), b) using a robot or portal robot (20) with a lifting head (26) to feed one of the reels (10 . . . 13) to one of a plurality of winding subassemblies (29) with operating spindles (33, 34) for receiving a respective one of the reels (10 . . . 13), c) unwinding the wound webs of packaging material at the winding subassemblies (29 . . . 32) by a horizontally directed operating spindle (33, 34) and feeding the webs of packaging material directly to the packaging machine, d) pivoting the operating spindles (33, 34) of each winding subassembly (29 . . . 32) between a horizontal operating position and an upright receiving position for the transfer of a reel (10 . . . 13), e) setting down the reel (10 . . . 13) received from the palette (10) by the robot or portal robot (20) on an intermediate carrier assigned to each of the winding subassemblies (29, 32) or on a carrying plate (41) with a vertical central opening (35) of the reel (10 . . . 13), f) transferring the reel (10 . . . 13) held ready on the intermediate carrier or on the carrying plate (41) as needed by way of downward movement of the intermediate carrier or the carrying plate (41) onto the operating spindle (33, 34) positioned in an upright receiving position, and g) pivoting the operating spindle (33, 34) with the reel (10 . . . 13) into the horizontal operating position.

18. The system as claimed in claim 17, wherein:

a) each of the winding subassemblies (29 . . . 32) has at least two operating spindles (33, 34) for each of the reels (10, 13), the operating spindles (33, 34) being spaced apart from each other, b) each of the operating spindles (33, 34) is pivotable independently about a horizontal axis, between a horizontal operating position and an upright receiving position in order to receive the reel (10 . . . 13) from the intermediate carrier or from the carrying plate (41), c) the reel (10 . . . 13) is positioned on the carrying plate (41) with a vertical central opening (35) and is set down on the operating spindle (33, 34), which is in an upright position, by the downward movement of the carrying plate (41), d) after transfer of the reel (10 . . . 13), the carrying plate (41) is moved away from the carrying spindle (33, 34) such that the carrying spindle (33, 34) is pivotable with the reel (10 . . . 13) into the horizontal operating position, e) the carrying plate (41) has an opening, configured as a slot (43), which corresponds with the central opening (35) of the reel (10 . . . 13), and f) the slot (43) is open in the direction of the pivoting movement of the operating spindle (33, 34) from the upright position into the horizontal operating position so that the operating spindle (33, 34) is movable into the horizontal operating position without impinging the carrying plate (41) with the reel (10 . . . 13).

19. The system as claimed in claim 18, wherein:

a) the reel (10 . . . 13) is set down, by the downward movement of the carrying plate (41), on a protrusion or collar (44) of the operating spindle (33, 34) in accordance with the operating position of the reel (10 . . . 13), b) the carrying plate (41) is movable further downward such that the reel (10 . . . 13) rests exclusively on the operating spindle (33, 34), and c) once the operating spindle (33, 34) is pivoted into the operating position, the carrying plate (41) is returnable, by way of upward movement, into a top, receiving position for a reel (10 . . . 13).

20. The system as claimed in claim 17, wherein:

a) the articulated arm (27) of the portal robot (20) has a lifting head (26) with a downwardly directed, vertical transporting or carrying spindle (78) for entering into a central opening (35) of the reel (10 . . . 13), b) the carrying spindle (78) comprises a cylindrical lateral surface (56), c) arranged inside the cylindrical lateral surface (56) are clamping jaws (60), which are movable radially or transversely to butt against an inner side of a reel core (36) forming the central opening (35), d) the clamping jaws (60) are movable outwardly by a central bracing cone (61), which is movable up and down, with bracing surfaces (62) and mating surfaces (63) interacting, e) the clamping jaws (60) are connected to the lateral surface (56) and are mounted in a displaceable manner in a respective aperture (64) of the lateral surface (56), and f) on account of being subjected to loading by the reel (10), the lateral surface (56) is movable downward relative to the bracing cone (61) such that the bracing forces of the clamping jaws (60) are increased due to the movement relative to the bracing cone (61).

21. The system as claimed in claim 20, wherein the clamping jaws (60) are connected to the bracing cone (61) in a form-fitting manner, but such that they are movable relative to one another via a dovetail connection (77) which is directed obliquely in a manner corresponding to the bracing surfaces (62) and mating surfaces (63).

22. The system as claimed in claim 20, wherein:

a) the lateral surface (56) of the carrying spindle (78) is movable in a vertical direction relative to a top, transversely directed carrying or head plate (57), b) the head plate (57) is connected by means of one or more carrying rods (58, 59) to the articulated arm (27), c) the lateral surface (56), which is designed in the form of a sleeve, is connected to the head plate (57) via upright carrying bolts (66), and d) the lateral surface (56) is supported elastically on springs (67), which are arranged on the carrying bolts (66), and pushed against the head plate (57) in the starting position.

23. The system as claimed in claim 17, wherein:

a) a lifting head (26) of the portal robot (20) has a transporting or carrying spindle (78) for entering into a central opening (35) in the reel (10 . . . 13), b) as a further carrying mechanism for gripping and retaining the reel (10 . . . 13), the lifting head (26) has a pneumatic lifting mechanism configured as a suction bell (69), which is fixed by means of negative pressure on a top side of the reel (10 . . . 13), c) the suction bell (69) is of annular design for gripping the reel (10 . . . 13) in a region concentric to the central opening (35), d) the suction bell (69) is mounted on the carrying rod (58) such that the suction bell is adjustable relative to the carrying spindle (78), e) the suction bell (69) is arranged on the guiding or carrying rod (58), which is upright and serves as a connection between the reel conveyor, or an extension arm of the same, and the carrying spindle (78), f) the suction bell (69) is fixed to the guiding or carrying rod (58) in any desired position relative to the carrying spindle (78), and g) the suction bell (69) is guided on the carrying rod (58) by a clamping mechanism (75) and is fixed to the carrying rod (58) by actuation of the clamping mechanism (75).

* * * * *